US007134657B2

(12) United States Patent
Yanagi et al.

(10) Patent No.: US 7,134,657 B2
(45) Date of Patent: Nov. 14, 2006

(54) SHEET MATERIAL GUIDING MECHANISM, AND SHEET MATERIAL FEEDING AND CONVEYING DEVICE PROVIDED WITH SUCH MECHANISM, AND RECORDING APPARATUS

(75) Inventors: Haruyuki Yanagi, Tokyo (JP); Yuji Nakano, Kanagawa (JP); Yuji Kanome, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 518 days.

(21) Appl. No.: 10/639,628

(22) Filed: Aug. 13, 2003

(65) Prior Publication Data

US 2004/0036208 A1 Feb. 26, 2004

(30) Foreign Application Priority Data

Aug. 21, 2002 (JP) ..... 2002-240236

(51) Int. Cl.
*B65H 1/00* (2006.01)

(52) U.S. Cl. ..... 271/171; 347/104

(58) Field of Classification Search ..... 271/171; 347/104

See application file for complete search history.

(56) References Cited

U.S. PATENT DOCUMENTS

| | | | | |
|---|---|---|---|---|
| 5,480,247 | A | 1/1996 | Saikawa et al. | |
| 5,931,456 | A | 8/1999 | Laidlaw | |
| 6,260,950 | B1 | 7/2001 | Tanno et al. | |
| 6,267,371 | B1 | 7/2001 | Jessop | |
| 6,416,050 | B1 * | 7/2002 | Niikura | 271/127 |
| 6,547,237 | B1 * | 4/2003 | Sugino et al. | 271/119 |
| 6,896,253 | B1 * | 5/2005 | Hanabusa | 271/117 |
| 6,926,269 | B1 * | 8/2005 | Ishikuro | 271/171 |
| 6,945,528 | B1 * | 9/2005 | Nakamura | 271/171 |
| 2003/0035039 | A1 | 2/2003 | Kanome et al. | |
| 2003/0063141 | A1 | 4/2003 | Sugiyama et al. | |

FOREIGN PATENT DOCUMENTS

| | | |
|---|---|---|
| JP | 6-115716 | 4/1994 |
| JP | 6-271094 | 9/1994 |
| JP | 7-206169 | 8/1995 |
| JP | 10-129848 | 5/1998 |
| JP | 11-165884 | 6/1999 |
| JP | 2002-037463 | 2/2002 |

* cited by examiner

*Primary Examiner*—Joseph Rodriguez
(74) *Attorney, Agent, or Firm*—Fitzpatrick, Cella, Harper & Scinto

(57) ABSTRACT

A sheet material guiding mechanism for guiding the edge portion of sheet material comprises a movable side guide capable of sliding corresponding to the sizes of sheet material, and being fixable in any position within the sliding area; a sheet guide section provided for the movable side guide in order to regulate the position of sheet material by butting against the edge of the sheet material; and an inner-side operating section provided for the movable side guide, being capable of releasing the fixed condition of the movable side guide by depression, hence making it possible to provide a sheet material guiding mechanism having a simple structure at lower costs, and producing the suppression effect against the skew of the sheet material with the easy operation that copes with disability.

19 Claims, 12 Drawing Sheets

SHEET MATERIAL GUIDING MECHANISM, AND SHEET MATERIAL FEEDING AND CONVEYING DEVICE PROVIDED WITH SUCH MECHANISM, AND RECORDING APPARATUS

BACKGROUND OF THE INVENTION

1. Field of the Invention

The present invention relates to a sheet material guiding mechanism capable of reliably guiding a sheet material to be fed. The invention also relates to a sheet material feeding and conveying device provided with such mechanism, as well as a recording apparatus, such as a printer, and facsimile equipment.

2. Related Background Art

Conventionally, a recording apparatus, such as a printer, a copying machine, and facsimile equipment, has used a post card, an envelope, and other thick paper sheets, and a thin plastic sheet and other special sheet materials, in addition to a plain paper sheet. The supply of sheet material has been performed one by one by manual insertion or by an automatic and continuous feeding by means of a sheet material feeding and conveying device. Then, for the execution of feeding and conveying operations, it is necessary to regulate the sheet material so as to feed it without skew. In the feeding portion, therefore, it is arranged to regulate both sides of sheet material by placing them along the guides when sheet material is stacked.

Usually, the reference of sheet material is established on one side. Therefore, the structure is arranged to fix the guide on the reference side, and make the guide on non-reference side movable. In the movable-guide structure of the kind, the movable guide pinches one side of the pressure plate, which enables the stacked sheet material to be biased to the feed roller, and then, the movable guide is made slidable on the pressure plate, thus fixing it in the predetermined position. As the structure for fixing the movable guide, the following is in practice, for example:

(1) A movable guide pinches a pressure plate, and the force of fixation for the movable guide is output only by the mold elasticity and friction coefficient thereof.

(2) An elastic member and a friction member are inserted between the movable guide and the pressure plate in order to output the force of fixation for the movable guide.

(3) The knurled portion is arranged for the pressure plate, and the engaging portion is provided for the movable guide corresponding to the knurled portion of the movable guide so as to enable it to be fixed in a position matching the size of a sheet material to be used. When the movable guide should move in accordance with the size of sheet material to be used, the operator nips the operating section of the movable guide. Then, the aforesaid engaging portion is released from the knurled portion to allow the movable guide to move.

However, the following problems are encountered in the conventional examples described above:

(1) It is difficult to set the optimum operating force with the structure in which the movable guide pinches the pressure plate to output the force of fixation for the movable guide only by the mold elasticity and friction coefficient thereof. In some case, the operating force is lowered due to such phenomenon as creeping or the like.

(2) The structure having the elastic member and friction member inserted between the movable guide and pressure plate makes it possible to provide the countermeasure needed for the set up of the operating force and the problem of creeping.

However, there is still a problem of increased costs, and the inferior operability when the force of fixation should increase in order to suppress the skew of a sheet material having a firmness that requires a stronger operating force.

(3) The locking mechanism that uses the knurled portion overcomes the aforesaid problems, but the operator is required to nip the operating section. Then, there is still a problem to be solved before realizing the operation that may be carried out by use of one finger, which is needed for eliminating the existing disability.

SUMMARY OF THE INVENTION

The present invention is designed with a view to solving the problems discussed above. It is an object of the invention to provide a sheet material guiding device having a simple structure at lower costs, being capable of producing the suppression effect on the skew of sheet material with the easier operation that copes with disability, and also, to provide a sheet material feeding and conveying device provided with this sheet material guiding mechanism, and a recording apparatus as well.

In order to achieve the aforesaid objects, the typical structure of the present invention is the sheet material guiding mechanism for guiding the edge portion of sheet material, which comprises a guide member slidable corresponding to the sizes of sheet material, while being fixable in any position within the slidable region; a regulating portion provided for the guide member for regulating the position of sheet material by abutting against the edge portion of the sheet material; and a fixation releasing portion provided for the guide member capable of releasing the fixed condition of the guide member by depression, and then, the fixation releasing portion is provided on the sheet material side.

With the structure thus arranged, it becomes possible to provide a sheet material guiding mechanism having a simple structure at lower costs, being capable of producing the suppression effect on the skew of sheet material with an easier operation that copes with disability.

DETAILED DESCRIPTION OF THE PREFERRED EMBODIMENTS (First Embodiment)

Figure 1:
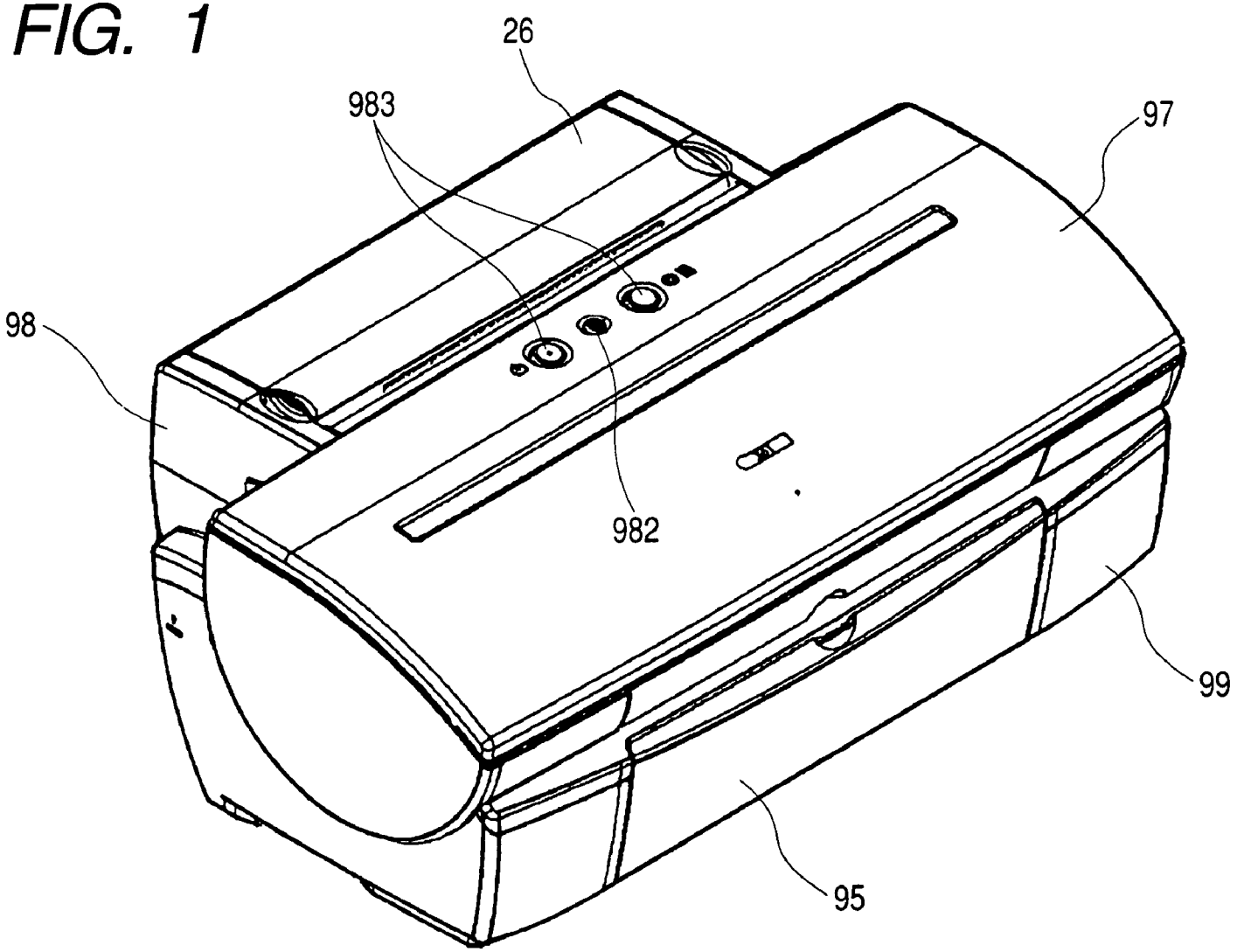
FIG. 1 is a perspective view that shows a recording apparatus in accordance with a first embodiment.
Figure 2:
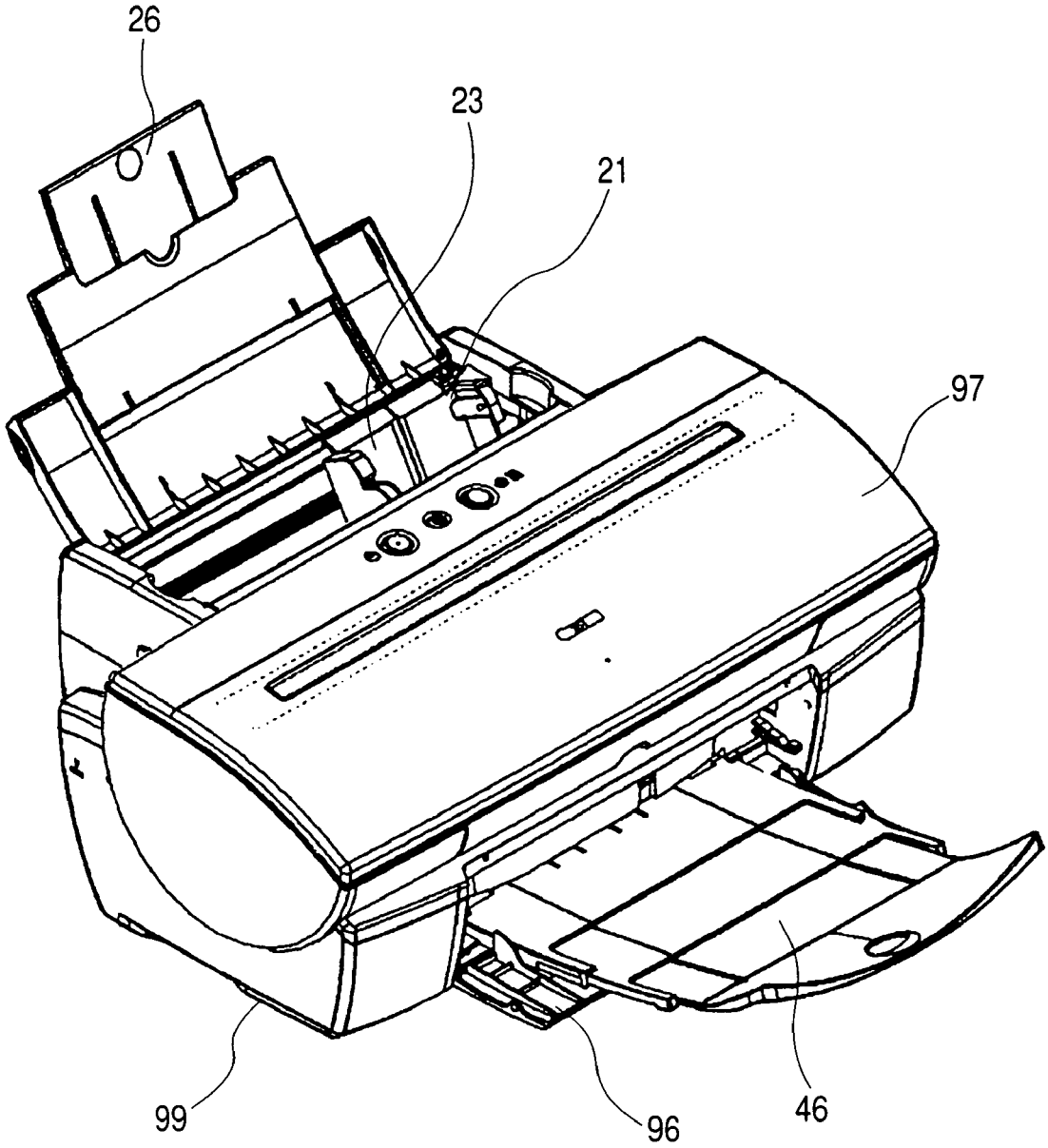
FIG. 2 is a perspective view that shows the recording apparatus in accordance with the first embodiment.
Figure 3:
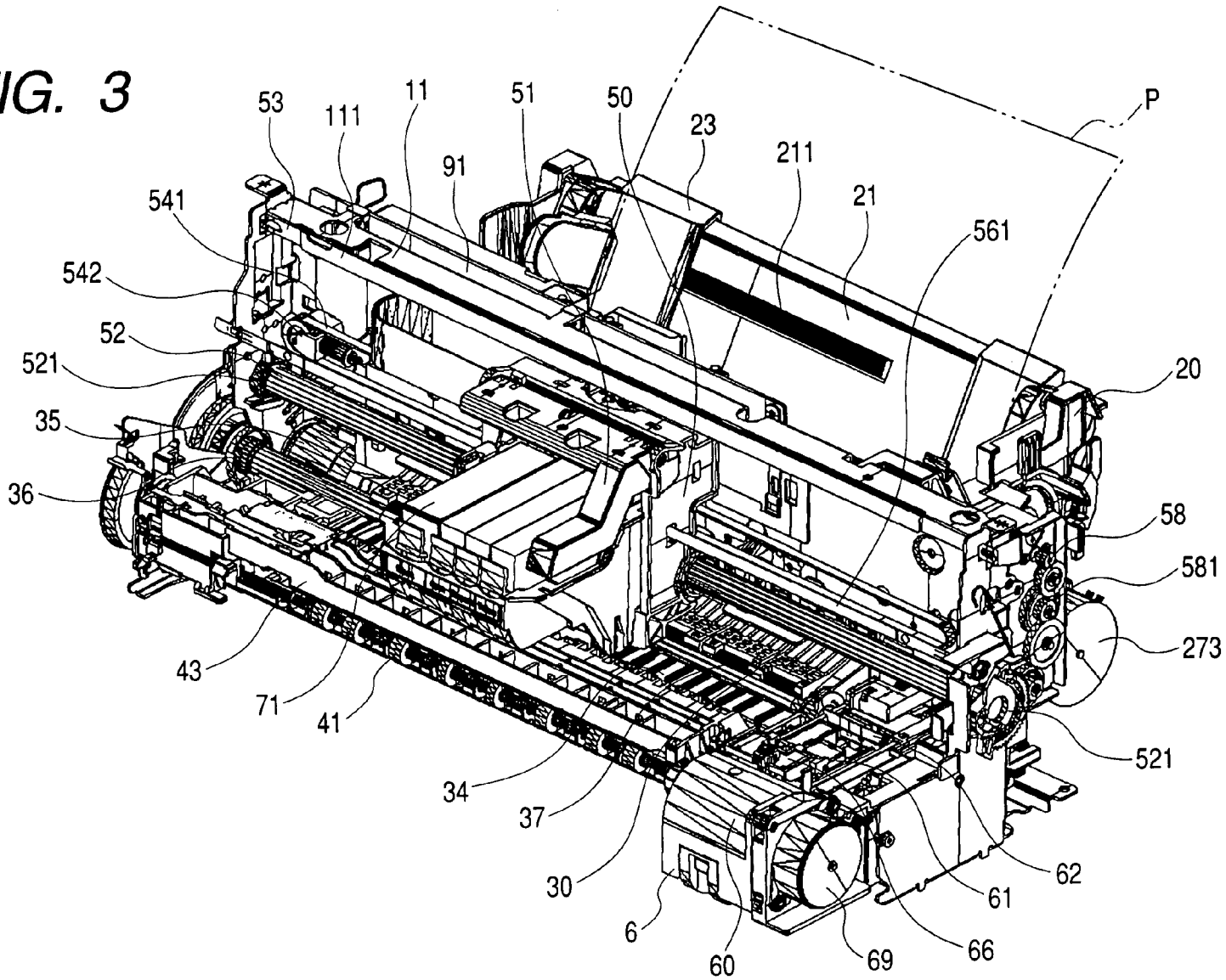
FIG. 3 is a perspective view that shows the mechanism unit of the recording apparatus in accordance with the first embodiment.
Figure 4:
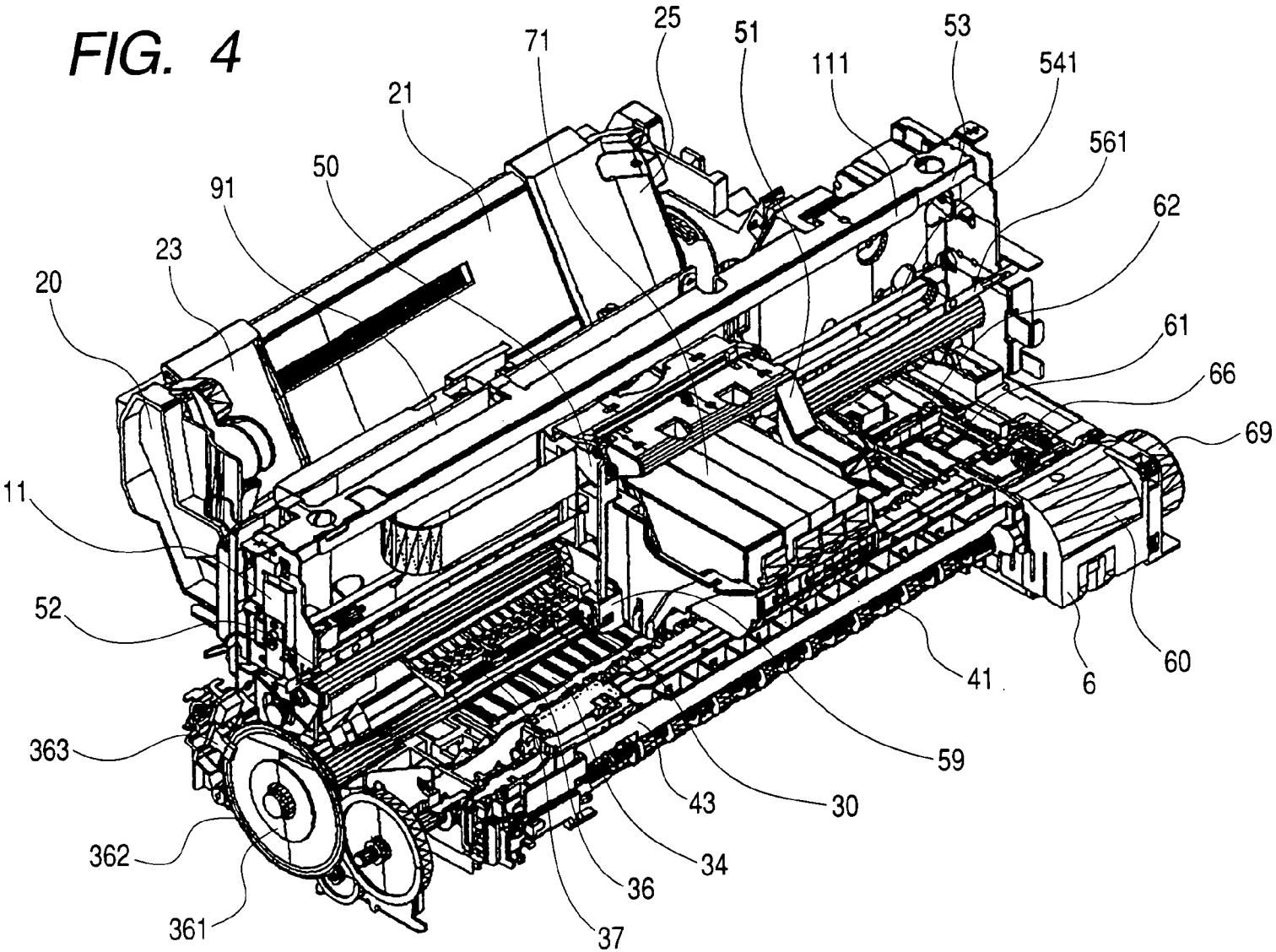
FIG. 4 is a perspective view that shows the mechanism unit of the recording apparatus in accordance with the first embodiment.
Figure 5:
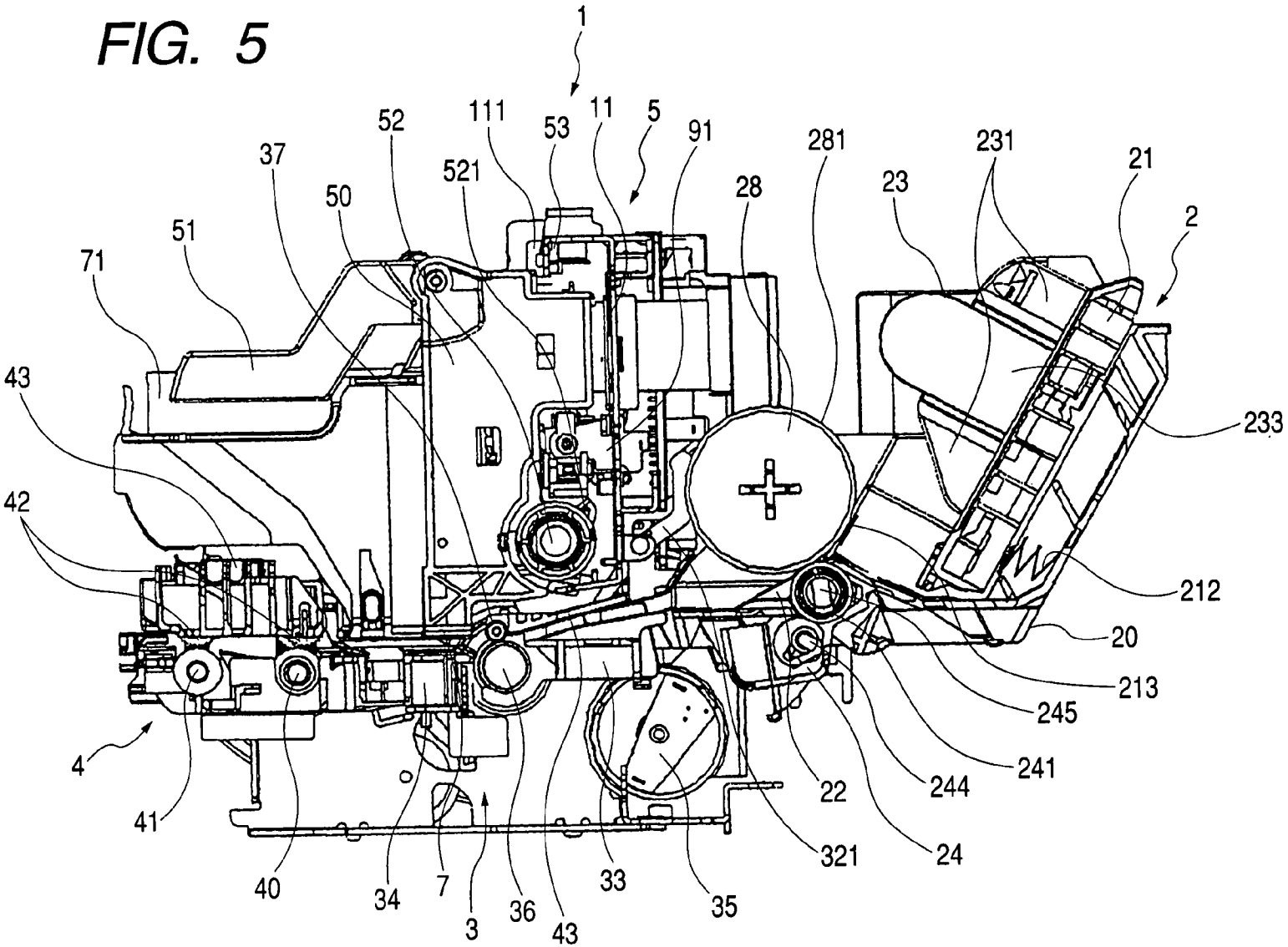
FIG. 5 is a cross-sectional view that shows the recording apparatus in accordance with the first embodiment.

In conjunction with FIGS. 1, 2, 3, 4, 5, 6, 7, 8, 9A, 9B, 9C, 10A, 10B, 11A, 11B, 12A, 12B and 12C, a first embodiment will be described in accordance with the present invention. FIG. 1 and FIG. 2 are perspective views that illustrate a recording apparatus in accordance with the first embodiment. FIGS. 3 and 4 are perspective views that illustrate the mechanism unit of the recording apparatus in accordance with the first embodiment. FIG. 5 is a cross-sectional view that illustrates the recording apparatus in accordance with the first embodiment. FIGS. 6, 7, 8, 9A, 9B, 9C, 10A, 10B, 11A, and 11B are views related to a sheet feeding and conveying device.

The recording apparatus 1 of the present embodiment is structured with the sheet feeding and conveying device 2, the sheet-conveying unit 3, the sheet-expeller unit 4, the carriage unit 5, the cleaning unit 6, and others. Now, these will be briefly described item by item.

(A) The Sheet Feeding and Conveying Unit

The sheet feeding and conveying unit (sheet material feeding and conveying device) 2 is formed by the pressure plate 21 having the stacking face on which sheet material P is stacked; the sheet-feeding roller 28, which constitutes feeding means for feeding the sheet material P; 241, the separation roller that separates one sheet material P from another; 22, the return lever that returns sheet material P to the stacking position, and some others. These are installed on a base 20.

Also, as shown in FIG. 2, the sheet-feeding tray 26, which holds stacked sheet material P, is fixed to the base 20 or the outer body. The sheet-feeding tray 26 is of multi-staged type, and it is drawn out for use.

Figure 6:
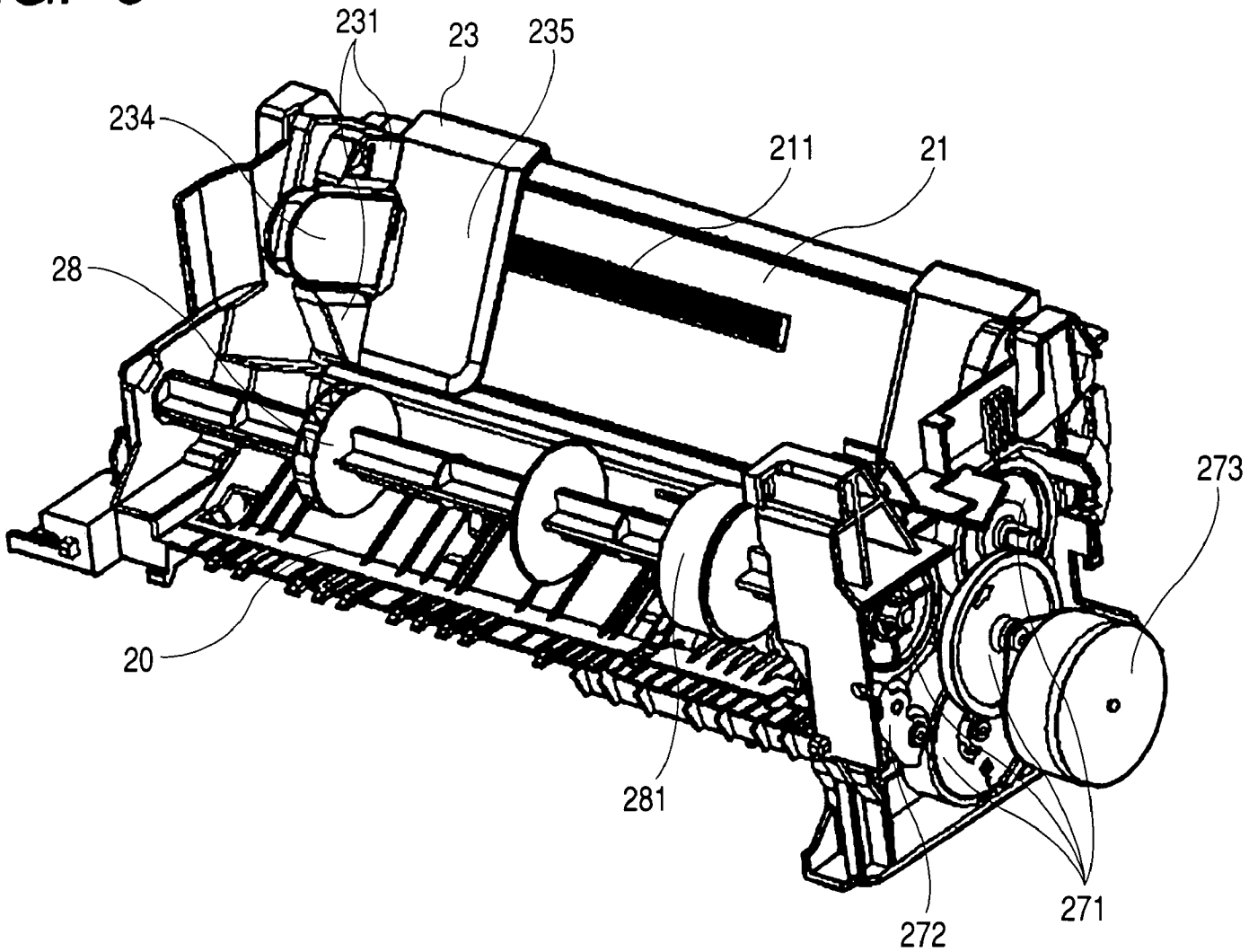
FIG. 6 is a perspective view that shows the feeding unit in accordance with the first embodiment.
Figure 7:
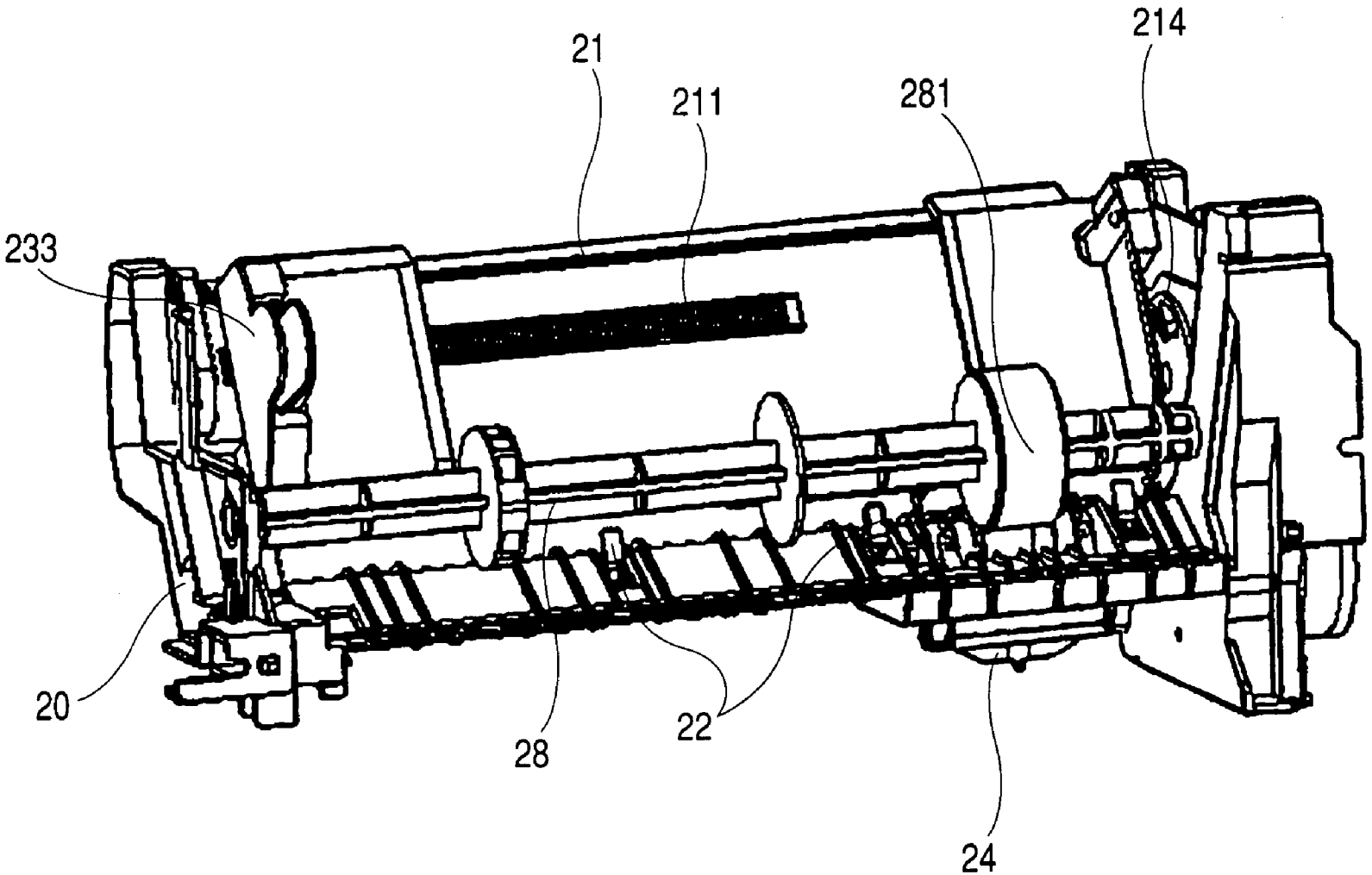
FIG. 7 is a perspective view that shows the feeding unit in accordance with the first embodiment.

The sheet-feeding roller 28 is in the form of a rod, the section of which is circular. One separation roller rubber 281 is provided nearer to the sheet material reference, with which the sheet material is fed for conveyance. As shown in FIG. 6, the driving is transmitted from a motor 273, which is provided for the sheet feeding and conveying unit 2 and dedicated for feeding and conveying use, to the sheet-feeding roller 28 by way of a driving transmission gear 271 and a planetary gear 272.

On the reference side of the aforesaid pressure plate 21, there is provided a stationary fixed side guide 25 as a first regulating member, which regulates the stacking position of sheet material P. On the non-reference side of the pressure plate 21, a movable side guide (guide member) 23 is movably installed as a second regulating member, thus regulating the stacking position of sheet material P. The pressure plate 21 is rotative around the center of the rotational shaft, which is connected with the base 20, and is biased to the sheet-feeding roller 28 by means of a pressure plate spring 212. On a location of the pressure plate 21, which faces the sheet-feeding roller 28, there is provided a separation sheet 213 (see FIG. 5) formed by material having a large friction coefficient, such as artificial leather, for preventing the double-conveyance of the sheet material P adjacent the top one on the stack. The pressure plate 21 is structured to be in contact with and away from the sheet-feeding roller 28 by means of a pressure plate cam 214 (see FIG. 7).

Further, the separation roller holder 24 having installed thereon the separation roller 241 for separating sheet material P one by one is fixed rotatively around the center of the rotational shaft provided for the base 20. The separation roller 241 is biased to the sheet-feeding roller 28 by use of a separation roller spring (not shown). For the separation roller 241, a clutch spring (not shown) is provided, and the structure is arranged so that if a load is applied beyond a designated value, the portion where the separation roller 241 is installed is made rotative.

The separation roller 241 is structured to abut against and retract from the sheet-feeding roller 28 by means of a separation roller-releasing shaft 244 and a control cam (not shown). Here, an ASF sensor (not shown) detects the positions of the pressure plate 21, the return lever 22, and the separation roller 241.

Also, the return lever 22 that returns sheet material P to the stacking position is installed on the base 20 rotatively, and biased by a return lever spring in the releasing direction. The structure is arranged so that when the sheet material P is returned, the control cam rotates clockwise in FIG. 5.

Here, the description will be made of the case where sheet material is fed and conveyed in the sheet feeding and conveying unit. In the usual standby status, the pressure plate 21 is released by means of the pressure plate cam 214, and the separation roller 241 is also released by means of the control cam. The return lever 22 is installed in the stacking position so as to close the stacker opening, which returns sheet material P, and prevent sheet material P from entering the deeper side.

When the feeding and conveying operation begins in this status, the separation roller 241 at first abuts against the sheet-feeding roller 28 by the motor driving. Then, the return lever 22 rotates counterclockwise to be released. The pressure plate 21 abuts against the sheet-feeding roller 28. In this condition, then, the feed and conveyance of sheet material P begins. The sheet material P is regulated by means of the front stage-separating unit provided for the base 20, and only designated numbers of sheet material P are carried to the nipping portion, which is formed by the sheet-feeding roller 28 and the separation roller 241. The nipping unit separates these numbers of sheet material P thus carried, and conveys only the uppermost sheet material P.

When the sheet material P arrives at the sheet-conveying roller 36, which will be described later, and a pinch roller 37, the pressure plate 21 is allowed to part from the sheet-feeding roller by means of the pressure plate cam 214. The separation roller 241 also parts from the sheet-feeding roller 28 by means of the control cam. Also, the return lever 22 rotates clockwise by means of the control cam, and returns to the stacking position. At this juncture, the sheet material P, which has arrived at the nipping portion formed by the sheet-feeding roller 28 and the separation roller 241, may be returned to the stacking position.

(B) The Sheet-conveying Unit

Next, the sheet-conveying unit will be described. The sheet-conveying unit 3 is installed on the chassis 11, which is formed by bending sheet metal. The sheet-conveying unit 3 is provided with a sheet-conveying roller 36 that conveys sheet material P, and the PE sensor (not shown), which detects the end portion of the sheet material. The sheet-conveying roller 36 is formed with the coating of fine ceramics grains on the surface of a metallic shaft, and the metallic portions of the shaft are received by bearings and installed on the chassis 11. A sheet-conveying roller tension spring is provided between the bearings and the sheet-conveying roller 36, which provides biasing force to the sheet-conveying roller 36, so as to give a load to the sheet-conveying roller 36 for the performance of stable conveyance.

For the sheet-conveying roller 36, plural pinch rollers 37, which follow the rotation thereof, are arranged to be in contact therewith. A pinch roller holder 30 holds the pinch rollers 37. A pinch roller spring (not shown) biases the pinch rollers 37 to be in contact with the sheet-conveying roller 36 under pressure, thus generating force to convey the sheet material P. Here, the rotational shaft of the pinch roller holder 30 is installed on the bearing of the chassis 11, and rotates around it as the center.

Further, at the entrance of the sheet-conveying unit 3 where sheet material P is being fed, the paper guide flapper 33 and the platen 34 are arranged to guide the sheet material P. Also, for the pinch roller holder 30, the PE sensor lever 321 is arranged to transmit the result of detection of the leading end and trailing end of the sheet material P to the PE sensor. The platen 34 is installed on the chassis 11 to be positioned.

The paper guide flapper 33 fits with the sheet-conveying roller 36 to be rotative around the sliding bearing portion as the center, and positioned by abutting against the chassis 11.

Also, on the sheet-material reference side of the platen 34, a sheet material holder is arranged to cover the edge portion of the sheet material P. With the setup thus arranged, it is made possible to prevent the deformed or curled edge of the sheet material P from floating to interfere with the carriage 50 or the recording head 7. Further, on the downstream side of the sheet-conveying roller 36 in the sheet material-conveying direction, the recording head 7 is provided to form images in accordance with image information.

With the structure arranged as described above, the pinch roller holder 30 and the paper guide flapper 33 guide the sheet material P, which is fed to the sheet-conveying unit 3, and carry it to a roller pair of the sheet-conveying roller 36 and the pinch roller 37. At this juncture, the PE sensor lever 321 detects the leading end of the sheet material P, which is thus carried, and with the result of this detection, the recording position of the sheet material P is obtained.

Also, the sheet material P is being carried on the platen 34 with the rotation of the roller pair 36 and 37 by use of the conveying motor 35. On the platen 34, ribs are formed to be the sheet-conveying reference surface, and it is structured so that while controlling a gap with the recording head 7, the ribs prevent the waving of the sheet material P from becoming large by controlling the waving thereof in cooperation with the expeller unit to be described later.

The driving, which is provided for the sheet-conveying roller 36 by the rotational force of the DC conveying motor 35, is transmitted through a timing belt to a pulley 361 provided on the shaft of the sheet-conveying roller 36. Also, on the shaft of the sheet-conveying roller 36, there is arranged a code wheel 362 having markings formed thereon at pitches of 150 to 300 lpi in order to detect the amount of conveyance by the sheet-conveying roller 36. Then, the encoder sensor 363 that reads the markings is installed on the chassis 11 in a position adjacent to that of the code wheel 362.

(C) The Carriage Unit

The carriage unit (recording means) 5 is provided with a carriage 50 on which the recording head 7 is installed. Here, the guide shaft 52, which enables the carriage to reciprocate for scanning in the direction at right angles to the conveying direction of sheet material P, and the guide rail 111, which holds the rear end of the carriage 50 for the maintenance of a gap between the recording head 7 and sheet material P, are arranged to support the carriage 50. The guide shaft 52 is installed on the chassis 11. Also, the guide rail 111 is integrally formed with the chassis 11. On sliding side of the guide rail 111 with respect to the carriage 50, a thin slid sheet 53 of SUS or the like is set up in order to reduce sliding noises.

Also, a carriage motor (not shown) fixed to the chassis 11 drives the carriage 50 through the timing belt 541. The timing belt 541 is tensioned around and supported by an idler pulley 542. The timing belt 542 is connected with the carriage 50 through a rubber damper or the like so as to attenuate the vibrations of the carriage motor and others, thus reducing unevenness of images or the like.

Then, the code strip 561 having the markings formed at the pitches of 150 to 300 lpi for the positional detection of the carriage 50 is provided in parallel with the timing belt 541. Further, the encoder sensor that reads the markings is provided for the carriage base plate that has the carriage 50 mounted thereon. For the carriage base plate, contacts are also provided to connect it electrically with the recording head 7. Also, for the carriage 50, a flexible board is provided in order to transmit head signals from an electric board 91 to the recording head 7.

For fixing the recording head 7 to the carriage 50, there are provided for the carriage 50 an abutting portion for positioning use, and pressing means for making pressurized fixation. The pressing means is mounted on a head set lever 51, and rotates centering on the head set lever 51 as the rotational fulcrum. Then, the structure is arranged to enable it to act upon the recording head 7 when it is set.

Also, on both ends of the guide shaft 52, eccentric cams 521 are provided, and it is arranged to enable the guide shaft 52 to ascend and descend by the transmission of the driving of motor gear 58 directly connected with the carriage ascend-descending motor to the eccentric cams 521 though a gear train 581. With this arrangement, the carriage 50 may ascend or descend to form the optimal gap with each sheet material P having different thickness.

Further, for the carriage 50, there is installed the tray position-detecting sensor 59, which is provided with the reflective photo-sensor for detecting the detection mark that indicates the tray position for use of CD printing.

For the recording head 7, an ink jet recording head is used, on which are mounted exchangeable ink tanks each separated for retaining different colors of ink. The ink discharge of the recording head 7 is structured in such a manner that the electrothermal converting element is energized in accordance with recording signals, and by the utilization of film boiling generated in ink by the thermal energy thereof, ink is bubbled, and that by the development and shrinkage of the bubble thus generated, ink is discharged from each of ink discharge ports for recording. With the ink discharges effectuated by the development and shrinkage of each bubble using the thermal energy, it is possible to attain the liquid discharges having excellent responses in particular.

With the structure arranged as described above, when images are formed on a sheet material P, the roller pair 36 and 37 conveys the sheet material P to the line position (the position in the conveying direction of the sheet material P) where images are formed, while the carriage 50 moves to the column position (the position perpendicular to the conveying direction of the sheet material P) where images are formed by use of the carriage motor. Thus, the recording head 7 is allowed to face the position of the image formation. After that, the recording head 7 discharges ink to the sheet material P in accordance with signals from the electric board 91 for the formation of images.

(D) The Expeller Unit

The expeller unit 4 is structured with two expeller rollers 40 and 41; a spur 42 formed to be rotative following the rotation of the expeller rollers 40 and 41 with which it is in contact under a specific pressure; a gear train to transmit the driving of the sheet-conveying roller to the expeller rollers 40 and 41, and others.

The expeller rollers 40 and 41 are installed on the platen 34. The expeller roller 40 on the upstream side is provided with plural rubber portions on a metallic shaft. The expeller roller 40 is driven by the driving force, which is transmitted from the sheet-conveying roller through an idler gear. The expeller roller 41 is structured with the installation of plural elastic members of elastomer on a resin shaft. The expeller roller 41 is driven by the driving force, which is transmitted from the expeller roller 40 through an idler gear.

The spur 42 is formed integrally with resin portion and thin SUS plate having plural extrusions on the circumference thereof, and installed on a spur holder 43. The spur 42 is installed on the spur holder 43 by use of the spur spring 44, which is provided with a rod type coil spring, and also, arranged to exert pressure to the expeller rollers 40 and 41, and others. The spur 42 is provided for each of the positions that face the rubber portions and elastic members of the expeller rollers 40 and 41, respectively. Some of them function to mainly generate the force to convey the sheet material P. The others, which are arranged between them in the positions having no rubber portions and elastic members of the expeller rollers, function to mainly suppress the floating of the sheet material when recording is made.

Between the expeller rollers 40 and 41, there is arranged a sheet material-edge portion supporter, which raise both edges of a sheet material P and holds the sheet material P in front of the expeller rollers 40 and 41 in order to avoid any damage that may be caused by rubbing the preceding sheet material P. Here, the structure is arranged so that a resin member having a roller on the leading end thereof is biased by a sheet material-end portion supporter spring to press the sheet material P under a predetermined pressure and raise both edges of the sheet material P for the provision of firmness thereto, thus making it possible to effectuate the intended holding performance.

With the structure as described above, the sheet material P, on which images are formed in the carriage unit 5, is nipped by the expeller roller 41 and the spur 42, and conveyed and expelled to an expeller tray 46. The expeller tray 46 is divided into plural portions, which are arranged and retained in the lower part of the lower case 99 to be described later. When the tray 46 is used, these portions are drawn out for use. The height of the tray is made larger toward the leading end thereof, and further, both edges thereof are made higher to enhance the stacking capability for the expelled sheet material P, while preventing the recorded surface thereof from being rubbed.

(E) The Cleaning Unit

As shown in FIGS. 3 and 4, the cleaning unit 6 is structured with a pump 60 that cleans the recording head 7, a cap 61 that suppresses the drying of the recording head 7, a blade 62 for cleaning the face plane around nozzles of the recording head 7, and others.

There are provided a motor 69 dedicated for cleaning use, and a one-way clutch so that with the rotation thereof in one direction, the pump is actuated, and with the rotation in the other direction, the blade 62 operates, and the cap 61 moves up and down.

The pump 60 is structured to generate negative pressure by squeezing two tubes by use of the pump roller. The connection between the cap 61 and the pump 60 is made through a valve in the path or the like. Then, it is arranged to suck unwanted ink and the like from the recording head 7 by actuating the pump 60 while airtightly closing the recording head 7 with the cap 61. For the cap 61, a cap absorbent is provided in order to reduce ink remains on the face plane of the recording head 7 after suction. Therefore, in order not to present any drawback here due to solidification of ink remainders, it is arranged to suck ink that remains in the cap 61 while keeping the cap 61 in the state of being open. The unwanted ink sucked by the pump 60 is absorbed and retained in a waste ink absorbent provided for the lower case 99 to be described later.

A series of operations, such as the movement of the blade 62, the up and down movement of the cap 61, and the opening and closing of the valve, is controlled by the main cam arrangement having plural cams installed on a shaft. Cams and arms on the respective locations are enabled to act by use of the main cam to execute the designated operations. The position of the main cam can be detected by use of a positional detection sensor, such as a photo-interrupter. When the cap 61 descends, the blade 62 moves vertically in the scanning direction of the carriage 5 to clean the face plane of the recording head 7. The blade 62 is provided in plural number, one cleans the nozzle circumferential area of the recording head 7, and the other cleans the entire face plane thereof. Then, when the blade moves to the deepest portion, it abuts against a blade cleaner 66, thus being able to remove ink and others adhering to the blade 62 itself.

(F) The Outer Body

Each of the units described so far is incorporated in the chassis 11, and forms the mechanical portion of a printer. The outer body is installed surrounding it. As shown in FIG. 1 and FIG. 2, it is arranged to form the outer body mainly by a lower case 99, an upper case 98, an access cover 97, a connector cover 96, and a front cover 95.

On the lower part of the lower case 99, an expeller roller tray rail is provided, and the structure is arranged to house the divided expeller tray 46. Also, the front cover 95 is formed to close the expeller opening when the tray is not in use.

For the upper case 98, the access cover 97 is fixed, and the structure is arranged to make it rotative. On a part of the upper face of the upper case 98, an opening portion is provided, and the structure is arranged so that the ink tank 71 and the recording head 7 can be exchanged in this location. Further, in order to detect the opening and closing of the access cover 97, there are provided for the upper case 98, a door switch lever, the LED guide 982, which transmits and indicates the LED light, the key switch 983, which acts upon the switches on the base plate, among some others.

Further, for the upper case 98, the multi-staged sheet-feeding tray 26 is rotatively installed. Then, the structure is arranged so that when the feeding and conveying unit is not in use, the sheet-feeding tray 26 becomes the cover for the feeding and conveying unit if it is put into the upper case.

Also, the upper case 98 and the lower case 99 are fixed by means of elastic fitting nails, and the connector cover 96 covers a portion where the connector unit is provided between them.

(G) The Movable Side Guide

Next, in conjunction with FIG. 6 to FIGS. 11A and 11B, the description will be made of the sheet material guide mechanism of the movable side guide 23 of the feeding and conveying unit in accordance with the present invention.

As shown in FIGS. 6, 7, 8, 9A, 9B and 9C, the structure is arranged to provide the movable side guide 23 for the pressure plate 21, and make it movable to the left- and right-hand sides. The movable side guide 23 is formed by ABS or other resin, and structured with the sheet material guide section (regulating portion) 231, which guides sheet material P at the time of stacking, and also, prevents it from being skewed when fed and conveyed, among some others; the knurling-counterpart 232, which engages with the knurled portion 211 of the pressure plate 21; the outer-side operating section 233, which enables the movable side guide 23 to move to the left-and right-hand sides when depressed by the operator so as to be in agreement with the size of a designated sheet; an inner-side operating section (fixation-releasing portion) 234; the stacking section 235, which stacks a part of sheet material; and the U-letter clipping section 236, which nips the upper end of the pressure plate 21 so as not to allow the movable side guide to be out of place.

Figure 8:
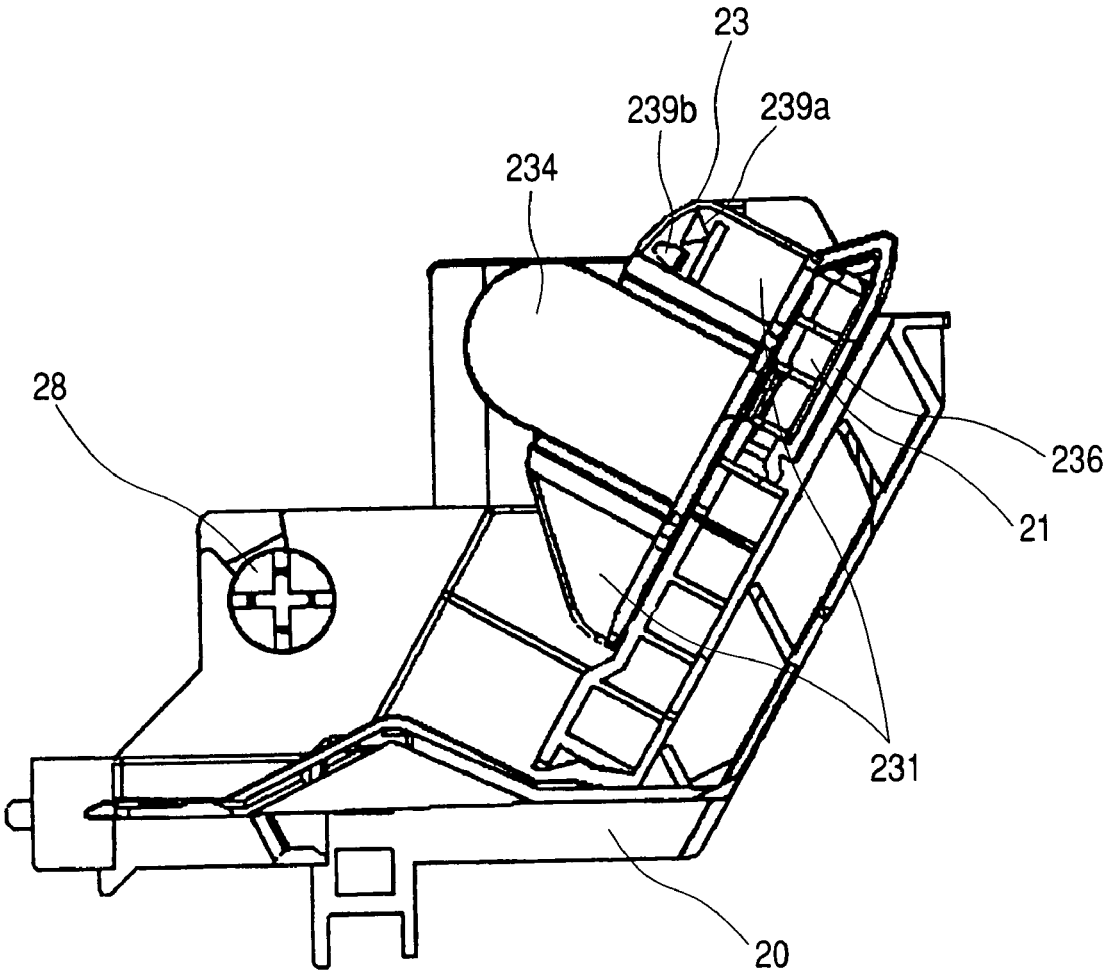
FIG. 8 is a cross-sectional view that shows the feeding unit in accordance with the first embodiment.

As shown in FIG. 8, when the movable side guide is incorporated with the pressure plate 21, the clipping section 236 opens by the elasticity of its own, and installed in such a manner that the stacking section 235 and clipping section 236 nip the pressure plate 21 from above and below. Then, the structure is arranged so that when the movable side guide 23 is incorporated at a designated position, a stopper works and it is not allowed to be out of the pressure plate 21. The structure is further arranged to enable it to move smoothly in the left and right directions with the clipping section 236 as the guide.

For the face of the pressure plate 21 on which sheet material P is stacked, the knurled section 211 is provided within a range corresponding to the range of movement of the movable side guide 23. The knurling configuration of the knurled section 211 of the present embodiment is the saw-tooth irregularity where extrusions, each having triangle section, are arranged in the direction intersecting with the sheet-material conveying direction. The inclined face of each extrusion is such that the first inclined face 211*a*, which is directed to the sheet-material reference side is more acute than the second inclined face 211*b*, which is directed to the side opposite thereto with respect to the stacking surface. In accordance with the present embodiment, the structure is arranged so that the first inclined face 211*a* on the sheet-material reference side is almost perpendicular (vertical plane) to the stacking surface, and the second inclined face 211*b* on the opposite side is angled at 45° to 60° (inclined plane). The pitch of knurling is formed to be approximately at 0.5 mm to 2.0 mm.

Also, the knurling counterpart (engaging portion) 232 of the movable side guide 23 that faces the knurled section 211 is provided with approximately two to four pieces of the triangle knurling configuration, which is arranged by inverting the aforesaid knurling section 211 upside down. In other words, the vertex of each triangle lies in the direction toward the pressure plate 21, and has an angle of 45° to 60° on the sheet-material reference side, and substantially perpendicular to the stacking surface on the opposite side. The pitch of this knurling is formed to be approximately 0.5 mm to 2.0 mm.

The knurling counterpart 232 of the movable side guide 23 is formed by resin to provide elasticity with respect to the movable side guide 23. Then, a stopper 237 is arranged so as not to deform the resin elastic portion if the inner-side operating section 234 is depressed too strongly. The knurling counterpart 232 is also biased by the elasticity of the supporting arm 232*b* serving as supporting means therefor, hence engaging with the knurling section 211. The knurling section 211, the knurling counterpart 232, the supporting arm 232*b*, and some others constitute the movement regulating means, which regulates the movement of the movable side guide 23.

Figure 9A:
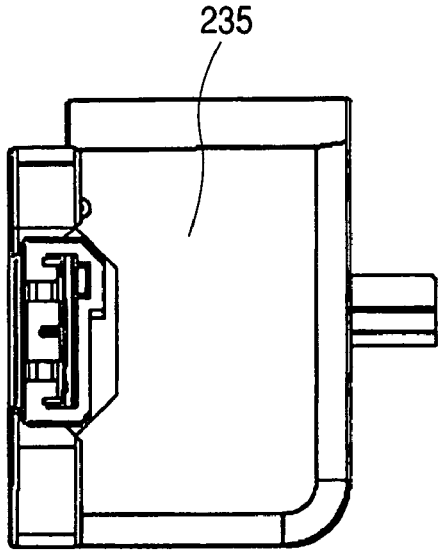
FIGS. 9A, 9B and 9C are views that illustrate the shape of the movable side guide in accordance with the first embodiment.
Figure 9B:
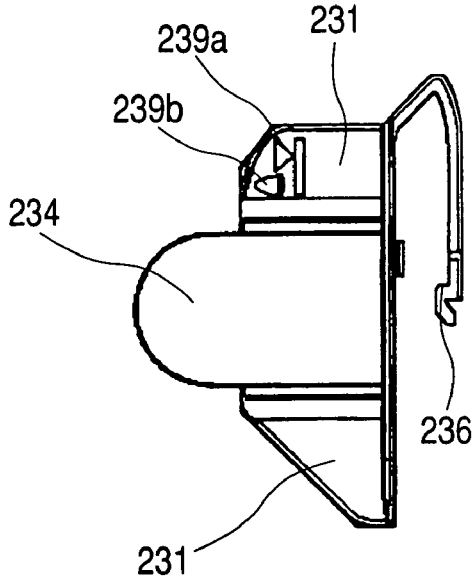
Figure 9C:
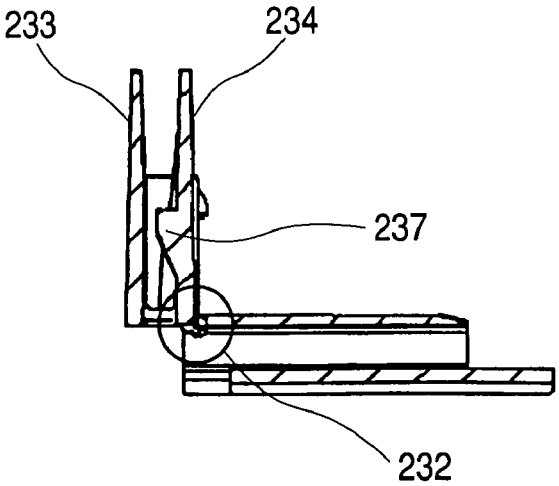

Also, as shown in FIG. 9B, on a part of the sheet material guide section 231 of the movable side guide 23, there is provided a stack indication 239*a*, which makes the stacking quantity observable for sheet material P to be stacked, and a stack regulating rib 239*b*, which regulates the stacking thereof.

Figure 10A:
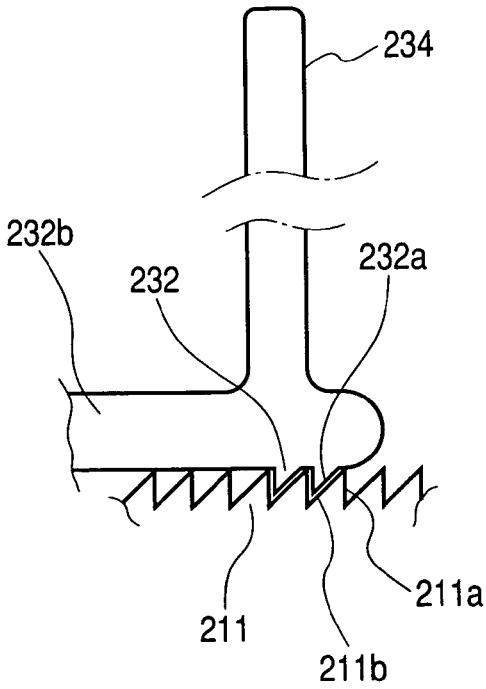
FIGS. 10A and 10B are views that illustrate the action of the movable side guide and the knurled portion of the pressure plate in accordance with the first embodiment (in a case where it moves from the non-reference side to the reference side).
Figure 10B:
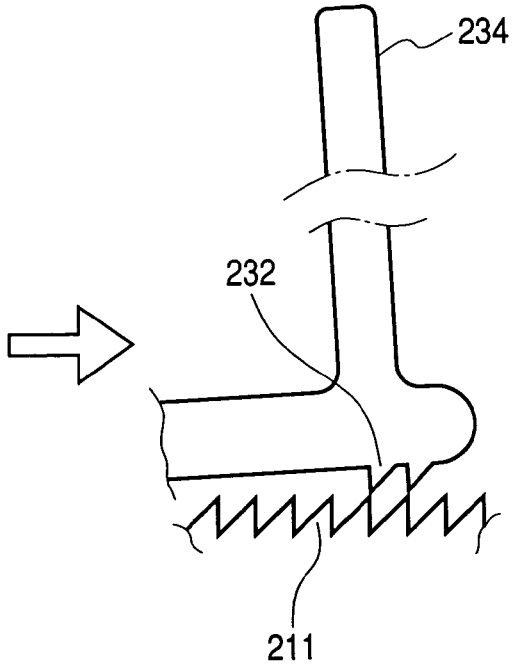

With the structure described above, the movable side guide 23 is caused to slide from the non-reference side of sheet material P to the reference side thereof, and when the sheet material guide section 231 of the movable side guide 23 abuts against the edge of the sheet material bundle stacked on the stacking surface, the outer-side operating section 233 is pressed in the direction toward the reference side. Then, as shown in FIGS. 10A and 10B, the second inclined face 211*b* of the knurling section 211 of the pressure plate 21 on the non-reference side, and the inclined face 232*a* of knurling of the knurling counterpart 232 of the movable side guide 23 on the reference side are allowed to be in contact, and then, the knurling counterpart 232 acts in the direction in which it escapes due to the elasticity thereof. Therefore, when the outer-side operating section 233 is depressed, the knurling counterpart 232 of the movable side guide 23 rides over the second inclined faces 211*b* one after another, and it becomes possible to enable the movable side guide 23 to slide easily.

However, when the movable side guide 23 is caused to slide in the opposite direction, that is, from the reference side to the non-reference side, the vertical faces of the knurling section 211 of the pressure plate 21, and the knurling counterpart 232 of the movable side guide 23 themselves abut against each other. Therefore, the force of the knurling counterpart 232 does not act in the escaping direction due to the elasticity thereof, and it is firmly locked in that position. Therefore, even if any force that may cause sheet material P to skew is exerted, the sheet-material guiding section 231 of the movable side guide 23 corrects it, hence suppressing the skew thereof.

Figure 11A:
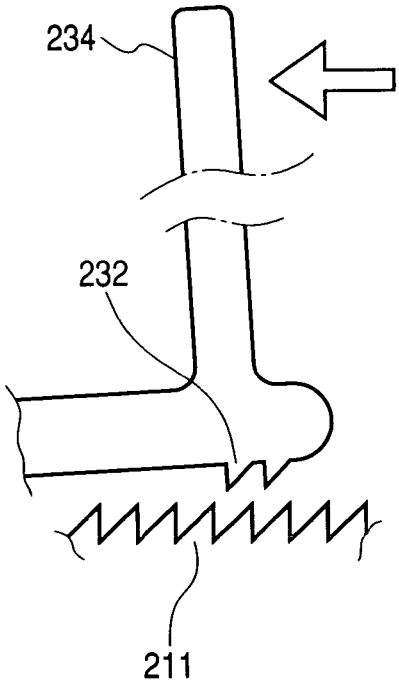
FIGS. 11A and 11B are views that illustrate the action of the movable side guide and the knurled portion of the pressure plate in accordance with the first embodiment (in a case where it moves from the reference side to the non-reference side).
Figure 11B:
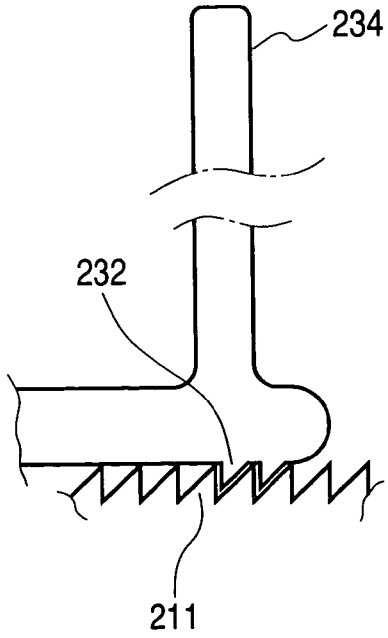

Also, the inner-side operating section 234 is arranged on the same side as the sheet material guiding section 231, which is located on the sheet-material P stacking side of the movable side guide 23. The lower end of the inner-side operating section 234 is connected immediately above the knurling of the knurling counterpart 232. Therefore, as shown in FIGS. 11A and 11B, when the inner-side operating section 234 is depressed, the elasticity thereof causes the inner-side operating section 234 to fall down inwardly. Then, since the lower end of the inner-side operating section 234 is connected immediately above the knurling of the knurling counterpart 232, the knurling counterpart 232 parts from the knurling section 211 of the pressure plate 21. Consequently, the locking mechanism of the movable side guide 23 is released to make it easier to enable it to slide.

Further, the inner-side operating section 234 is arranged in a position away from the surface of the sheet material guiding section 231 approximately by 0.5 to 1.0 mm, and away from the sheet material P (that is, a position on the non-reference side). Therefore, even if the sheet material P is caused to skew, the sheet material P acts upon only the sheet material guiding section 231, and there is no possibility that the edge portion of the sheet material abuts against the inner-side operating section 234, and that the inner-side operating section 234 acts and causes the movable side guide 23 to move at all.

As described above, with a simple structure, it is possible to easily move the movable side guide 23 in one direction by use of one finger without nipping the outer-side operating section 233 and the inner-side operating section 234. Then, it is possible to set the operating force with the elasticity of the knurling counterpart 232 arranged to be a predetermined value. Also, the operating force that should be set can be established separately, from the locking force capable of retaining the position when the sheet material guiding section 231 of the movable side guide 23 is depressed. As a result, it becomes easier to make the locking force larger, while setting the operating force, and others at a smaller value.

(Second Embodiment)

Next, with reference to FIGS. 12A, 12B and 12C, the description will be made of a second embodiment in accordance with the present invention. Here, only the portions that differ from those described in the first embodiment will be described.

In accordance with the first embodiment, the movable side guide 23 is formed with ABS or other resin material, and the knurling counterpart 232 is enabled to act upon the knurling section 211 of the pressure plate 21 by means of the elasticity of the resin material.

Figure 12A:
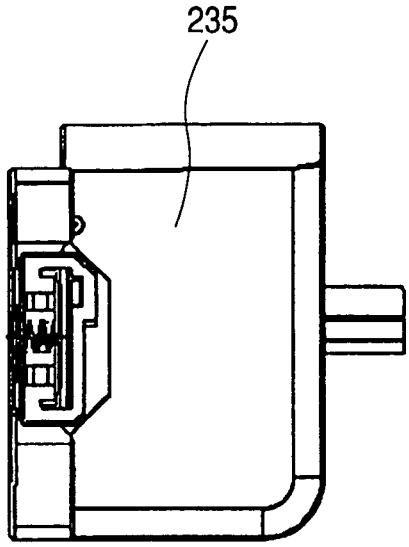
FIGS. 12A, 12B and 12C are views that illustrate the shape of a movable side guide in accordance with a second embodiment.
Figure 12B:
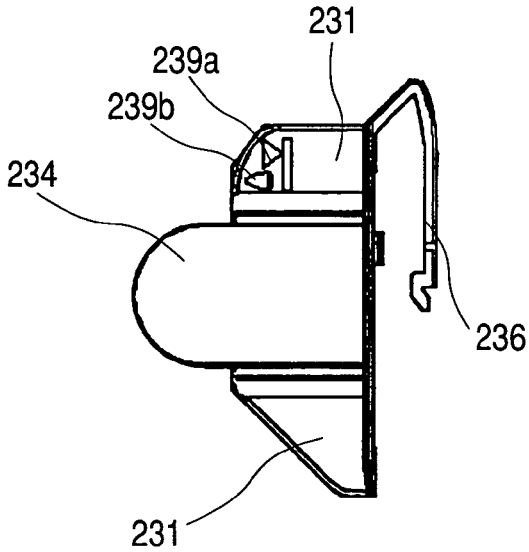
Figure 12C:
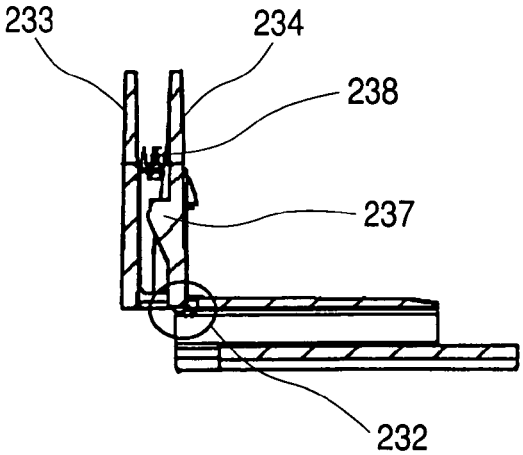

However, as shown in FIGS. 12A, 12B and 12C, it may be possible to provide a lock spring (biasing means) 238 in the form of a compression coil spring or the like between the outer-side operating section 233 and the inner-side operating section 234. With the structure thus arranged, the knurling counterpart 232 is pressed to the knurling section 211 by the biasing force of the lock spring 238 to make the contact action of the knurling become more reliable. Then, even if the movable side guide 23 and the pressure plate 21 should be distorted, the locking force is not lowered. As a result, it becomes possible to make the pitches of the aforesaid knurling smaller and fix the movable side guide 23 at more precisely arranged positions.

(Third Embodiment)

Figure 13:
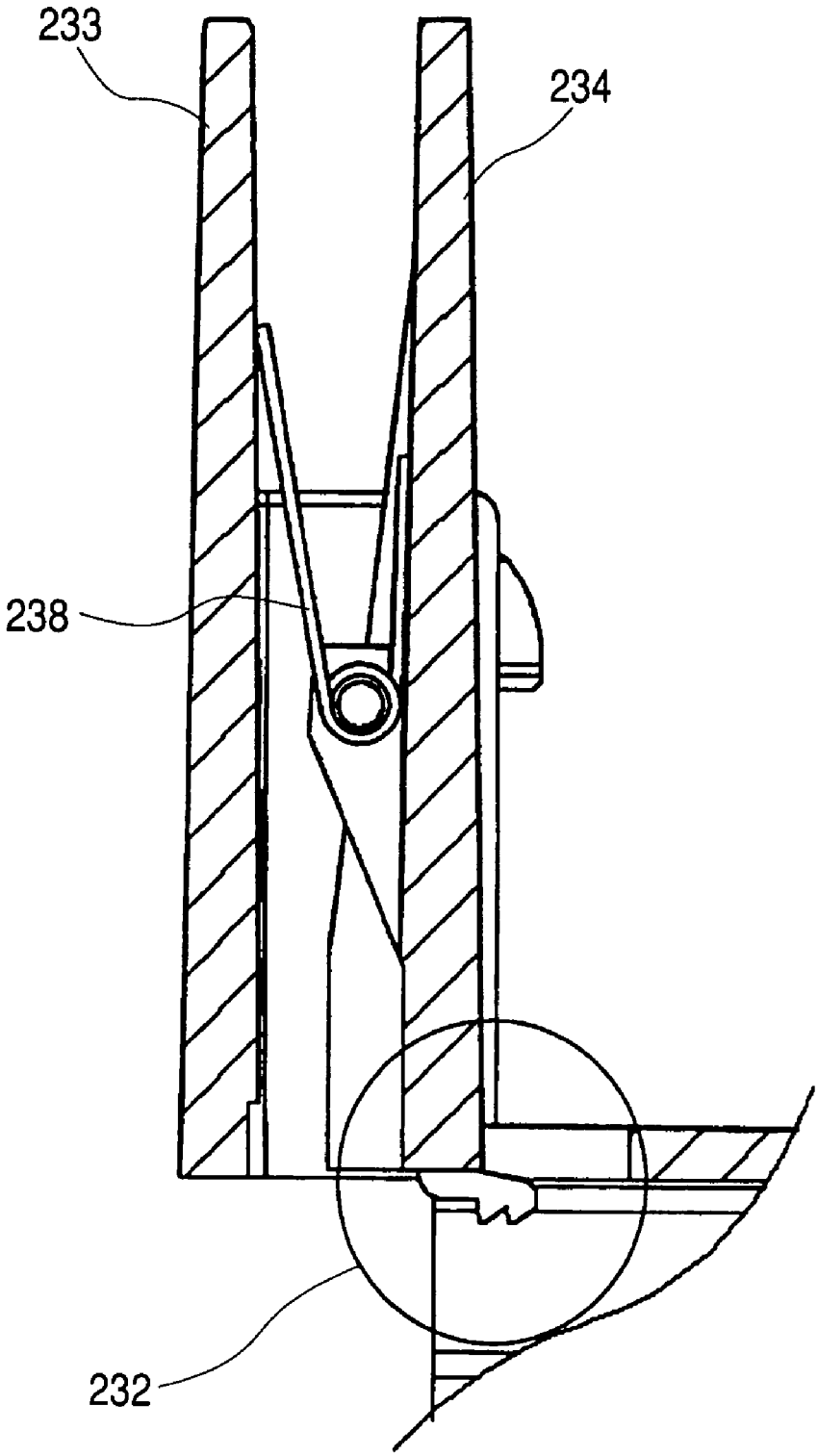
FIG. 13 is a view that shows the structure of a movable side guide in accordance with a third embodiment.

Next, with reference to FIG. 13, the description will be made of a third embodiment in accordance with the present invention. Here, too, only the portions that differ from those of the first embodiment will be described.

In accordance with the first embodiment, the movable side guide 23 is integrally formed with resin material. However, as shown in FIG. 13, the portion where the inner-side operating section 234 and the knurling counterpart 232 are integrally formed is produced by a separate component, and with the provision of the rotational center therefor, it may be possible to enable the knurling counterpart 232 and the knurling of the knurling section 211 to abut against each other by means of a lock spring 238 in the form of a twisted coil spring or the like.

With the structure thus arranged, the contact action of the knurling counterpart 232 and the knurling of the knurling section 211 becomes more reliable as in the case of the second embodiment. Then, even if the distortions of the movable side guide 23, the pressure plate 21, or the like should occur, the locking force is not lowered. Consequently, the pitches of the knurling can be made smaller, and the movable side guide 23 can be fixed at more precisely arranged positions.

(Other Embodiment)

For the embodiments described earlier, the example is shown, in which one edge portion of sheet material abuts against the fixed reference for guidance, and the movable side guide 23, which is made slidable, guides the other edge thereof. However, it may be possible to provide the movable side guides 23, each being formed in the same manner as described earlier, on both sides in the widthwise direction of sheet material, and then, to guide both edges of sheet material. In this way, it becomes possible to perform the sheet-material conveyance in accordance with the central reference thus made available.

Also, for the embodiments described earlier, the example is shown in which the ink jet recording method is adopted as recording means. However, the recording method is not necessarily limited thereto. The present invention is also applicable to the other recording methods, such as the electro-photographic recording method.

Further, the sheet material guiding mechanism described earlier is adoptable not only for the recording apparatus, but also, it is preferably adoptable for a reading apparatus, such as a scanner, for which sheet type source documents are set on a stacker, and fed and conveyed one by one for reading by optical reading means.

In accordance with the present invention described above, it is possible to provide a sheet material guiding mechanism simply structured at lower costs, which deals with creeping, and produces excellent effect on the skew suppression of firm sheet material, with an easy one-finger operation made available for overcoming the disability.

Also, in accordance with the present invention, the operating force for the guiding members, and the force needed for the fixation thereof can be set separately by different structures, hence making it possible to set the operating force weakly, while setting the fixing force strongly.

What is claimed is:

1. A sheet material guiding mechanism for guiding the edge portion of sheet material, comprising:

a guide member slidable within a slidable region, while being fixable at a position corresponding to the size of the sheet material;

a regulating portion provided for said guide member for regulating the position of the sheet material by abutting against the edge portion of the sheet material; and a fixation releasing portion provided for said guide member capable of releasing the fixed condition of said guide member by depression, wherein said fixation releasing portion is opposed to the edge portion of the sheet material when said regulating portion is in contact with the edge portion of the sheet material and provided at a position where said fixation releasing portion is not in contact with the edge portion of the sheet material, a knurling section is formed for a sliding surface of said guide member, and a knurling counterpart is formed for said guide member to engage with the knurling section, and the knurling counterpart is supported by support means and said support means is elastically deformed if said fixation releasing portion is pressed in a direction apart from the sheet material so that the knurling counterpart is spaced apart from the knurling section and moved in a direction to separate said guide member from the sheet material.

2. The sheet material guiding mechanism according to claim 1, wherein said fixation releasing portion is provided in a position having a greater distance from the sheet material to be guided than said regulating portion.

3. The sheet material guiding mechanism according to claim 1, wherein said guide member is made slidable by being depressed in a direction toward the sheet material.

4. The sheet material guiding mechanism according to claim 1, wherein the knurling counterpart retracts from the knurling section when said fixation releasing portion is depressed, and the fixation of said guide member is released.

5. A sheet material guiding mechanism for guiding the edge portion of sheet material, comprising:

a guide member slidable corresponding to the size of the sheet material, while being fixable in any position within a slidable region;

a regulating portion provided for said guide member for regulating the position of the sheet material by abutting against the edge portion of the sheet material; and a fixation releasing portion provided for said guide member capable of releasing the fixed condition of said guide member by depression, wherein said fixation releasing portion is provided on a sheet material side, wherein a knurling section is formed for a sliding surface of said guide member, and a knurling counterpart is formed for said guide member to engage with the knurling section, wherein the knurling section is configured to have almost saw-tooth triangles each having a substantially vertical face and an inclined face at a predetermined angle to the vertical face, and the knurling counterpart is configured to have almost triangles corresponding to the knurling section, and with respect to the force to said guide member exerted in the direction of the sheet material to be guided, the vertical faces of triangles of the knurling section and the knurling counterpart abut each other, and with respect to the force to said guide member exerted in the direction opposite to the sheet material to be guided, the inclined faces of triangles of the knurling section and the knurling counterpart abut each other.

6. The sheet material guiding mechanism according to claim 1, wherein a stopper is provided for preventing the distortion of said fixation releasing portion due to depression.

7. The sheet material guiding mechanism according to claim 1, wherein biasing means is provided for urging the knurling counterpart to the knurling section.

8. A sheet feeding and conveying device for performing feed and conveyance while guiding sheet material comprising:

the sheet material guiding mechanism according to any one of claims 1-3 and 4-7, and feed and conveying means for conveying the sheet material.

9. A recording apparatus for recording on sheet material to be fed and conveyed, comprising:

the sheet feeding and conveying device according to claim 8.

10. The recording apparatus according to claim 9, wherein said recording apparatus discharges ink using recording means for energizing electrothermal converting elements in accordance with signals, and thermal energy generated by the electrothermal converting elements.

11. A sheet material stacking device comprising:

a stacking surface for stacking sheet material;

a first regulating member abutting against a first edge of sheet material stacked on said sheet stacking surface to regulate the first edge to a predetermined position;

a second regulating member movable along said stacking surface to abut against a second edge opposite to the first edge for regulating the position of the second edge;

movement regulating means for regulating the movement of said second regulating member; and an operating section for making the movement regulation of said movement regulating means weaker, wherein the movement regulation of said movement regulating means is made weaker by depressing said operating section in the direction parting from the stacked sheet material, wherein said movement regulating means is provided with irregularities continuously arranged in a moving direction of said second regulating member, and an engaging portion for fitting the irregularities by moving integrally with said second regulating member, wherein supporting means is provided for supporting the engaging portion so as to enable the engaging portion to move in the direction parting from the irregularities when said operating section is depressed in the direction parting from stacked the sheet material, wherein said supporting means supports said operating section and the engaging portion to be movable integrally, and the engaging portion moves by depressing said operating section in the direction parting from the stacked sheet material, and wherein said operating section is pressed to be separated from the stacked sheet material so that the supporting means is elastically deformed and thereby the engaging portion is separated from the irregularities.

12. The sheet material stacking device according to claim 11, wherein the force for depressing said operating section in the direction parting from the stacked sheet material is transmitted to said second regulating member as the force for enabling said second regulating member to move in the direction parting from the stacked sheet material.

13. The sheet material stacking device according to claim 11, wherein the supporting means biases the engaging portion in a direction to fit the irregularities.

14. The sheet material stacking device according to claim 13, wherein the irregularities are provided with a plurality of first inclined faces orientated to a direction of said second regulating member approaching the stacked sheet material, and a plurality of second inclined faces orientated to the opposite direction, and the first and second inclined faces are provided to be arranged alternately, and a force for enabling said second regulating member to move in the direction approaching the stacked sheet material overcomes the biasing force of the supporting means to act as the force to ride over the second inclined faces.

15. The sheet material stacking device according to claim 14, wherein the first inclined faces are more acute than the second inclined faces.

16. The sheet material stacking device according to claim 11, wherein said second regulating member is provided with a regulating portion to abut against the second edge of the sheet material, and said operating section is arranged in a position away from the sheet edge abutting against said regulating portion on the same side of said regulating portion of said second regulating member.

17. A sheet material feeding and conveying device comprising:

a sheet material stacking device according to any of claims 11 and 12–16;

sheet feeding and conveying rollers for feeding and conveying the sheet material stacked on said sheet material stacking device; and a separation roller for separating the sheet material.

18. A recording apparatus comprising:

a sheet material feeding and conveying device according to claim 17; and recording means for recording on sheet material fed and conveyed by said sheet material feeding and conveying device.

19. The recording apparatus according to claim 18, wherein said recording apparatus discharges ink using said recording means for energizing electrothermal converting elements in accordance with signals, and thermal energy generated by the electrothermal converting elements.

* * * * *

UNITED STATES PATENT AND TRADEMARK OFFICE

CERTIFICATE OF CORRECTION

PATENT NO. : 7,134,657 B2
APPLICATION NO. : 10/639628
DATED : November 14, 2006
INVENTOR(S) : Yanagi et al.

It is certified that error appears in the above-identified patent and that said Letters Patent is hereby corrected as shown below:

COLUMN 7:
Line 46, "raise" should read --raises--.

COLUMN 13:
Line 65, "claims 1-3 and 4-7," should read --claims 1-7,--.

COLUMN 14:
Line 35, "stacked the" should read --the stacked--.

COLUMN 15:
Line 11, "claims 11 and 12-16," should read --claims 11 to 16,--.

Signed and Sealed this

Fifteenth Day of July, 2008

JON W. DUDAS
*Director of the United States Patent and Trademark Office*